US009200215B2

(12) United States Patent
Hwang et al.

(10) Patent No.: US 9,200,215 B2
(45) Date of Patent: Dec. 1, 2015

(54) PROCESS FOR REDUCING THE BENZENE CONTENT OF GASOLINE

(75) Inventors: Shyh-Yuan H. Hwang, Needham, MA (US); Ronald Birkhoff, Houston, TX (US); Richard F. Guarino, Fairhaven, MA (US); J. Erik Moy, South Grafton, MA (US); Joseph C. Peters, Quincy, MA (US)

(73) Assignee: BADGER LICENSING LLC, Boston, MA (US)

( * ) Notice: Subject to any disclaimer, the term of this patent is extended or adjusted under 35 U.S.C. 154(b) by 294 days.

(21) Appl. No.: 13/982,944

(22) PCT Filed: Nov. 30, 2011

(86) PCT No.: PCT/US2011/062626

§ 371 (c)(1),
(2), (4) Date: Aug. 23, 2013

(87) PCT Pub. No.: WO2012/108924

PCT Pub. Date: Aug. 16, 2012

(65) Prior Publication Data

US 2013/0331626 A1 Dec. 12, 2013

Related U.S. Application Data

(63) Continuation of application No. PCT/US2011/023900, filed on Feb. 7, 2011.

(51) Int. Cl.

| | |
|---|---|
| ***C07C 2/66*** | (2006.01) |
| ***C10G 49/08*** | (2006.01) |
| ***C10G 29/20*** | (2006.01) |

(52) U.S. Cl.

CPC ..... *C10G 49/08* (2013.01); *C10G 29/205* (2013.01)

(58) Field of Classification Search

USPC ..... 585/447, 467

See application file for complete search history.

(56) References Cited

U.S. PATENT DOCUMENTS

| | | | | |
|---|---|---|---|---|
| 3,775,483 | A | 11/1973 | Frederickson et al. | |
| 4,343,957 | A | 8/1982 | Sartorio et al. | |
| 4,393,262 | A | 7/1983 | Kaeding | |
| 4,891,458 | A | 1/1990 | Innes et al. | |
| 4,950,823 | A | 8/1990 | Harandi et al. | |
| 5,149,894 | A | 9/1992 | Holtemrann et al. | |
| 5,491,270 | A | 2/1996 | Chin et al. | |
| 5,545,788 | A | 8/1996 | Cheng et al. | |
| 6,008,422 | A | 12/1999 | Schultz et al. | |
| 6,835,862 | B1 | 12/2004 | Gajda et al. | |
| 7,476,774 | B2 | 1/2009 | Umansky et al. | |
| 7,652,181 | B1 * | 1/2010 | Schmidt et al. | 585/323 |
| 2006/0194999 | A1 | 8/2006 | Brown et al. | |
| 2008/0171900 | A1 | 7/2008 | Scmidt | |
| 2010/0210886 | A1 | 8/2010 | Brown et al. | |
| 2010/0249472 | A1 | 9/2010 | Clark et al. | |
| 2010/0300930 | A1 | 12/2010 | Clark et al. | |

FOREIGN PATENT DOCUMENTS

| | | | |
|---|---|---|---|
| EP | 0485683 | A1 | 11/1990 |
| WO | 2012108861 | A1 | 8/2012 |
| WO | 2012108926 | A1 | 8/2012 |
| WO | 2013028215 | A1 | 2/2013 |

OTHER PUBLICATIONS

Laredo G C et al.: "Benzene reduction in gasoline by alkylation with olefins: Effect of the experimental conditions on 1 the product selectivity", Applied Catalysis A: General, Elsevier Science, Amsterdam, NL vol. 384, No. 1-2, Aug. 20, 2010, oages 115-121.

Umansky B et al.: "Banish the benzene, boost the octane", Hydrocarbon Engineering, Palladian Publications, Farnham, GB, vol. 12, Jan. 1, 2007, pp. 61-62.

El-Mekki El Malki, Michael Clark: "BenzOUT Reducing Benzene Enhancing Gasoline Product Value", NPRA Conference, Phoenix, AZ, Mar. 21-23, 2010; XP00263231 1.

Pierre Leprince: "Le raffinage du petrole -3.Procédés de Transformation", Jan. 1, 1998, Technip, Paris, XP002670362, vol. 3.

The International Search Report and the Written Opinion of the International Searching Authority issued in corresponding international application No. PCT/US2011/062626.

The International Search Report and the Written Opinion of the International Searching Authority issued in related international application No. PCT/US2011/023904.

The International Search Report and the Written Opinion of the International Searching Authority issued in related international application No. PCT/US2011/062635.

The International Search Report and the Written Opinion of the International Searching Authority issued in related international application No. PCT/US2011/062648.

* cited by examiner

*Primary Examiner* — Thuan D Dang

(74) *Attorney, Agent, or Firm* — Roberts Mlotkowski Safran & Cole, P.C.

(57) ABSTRACT

In a process for alkylating benzene contained in a benzene-containing refinery gasoline stream, the benzene-containing refinery gasoline stream is contacted with an alkylating agent selected from one or more C2 to C5 olefins in at least one alkylation reaction zone under alkylation conditions to produce an alkylated effluent which has reduced benzene content as compared with said refinery gasoline stream and is essentially free of said alkylating agent. An aliquot of the alkylated effluent is then recycled to the one at least one alkylation reaction zone such that the molar ratio of alkylatable aromatic compounds to said alkylating agent in the combined refinery gasoline and recycle streams introduced into the at least one alkylation reaction zone is at least 1.0:1.

12 Claims, No Drawings

PROCESS FOR REDUCING THE BENZENE CONTENT OF GASOLINE

CROSS-REFERENCE TO RELATED APPLICATIONS

The present Application is a U.S. National Phase of international application PCT/US2011/062626 filed on Nov. 30, 2011 which claims priority of the filing date of PCT/US2011/023900 filed on Feb. 7, 2011. The disclosure of the international application PCT/US2011/062626 is hereby incorporated by reference into the present Application.

FIELD

This invention relates to a process for reducing the benzene content of gasoline.

BACKGROUND

Benzene is considered to be environmentally hazardous. As a result, the State of California and the United States Environmental Protection Agency have instituted regulations to limit the amount of benzene which may be present in gasoline. As of January 2011, the US MSAT-2 (Mobile Source Air Toxics) regulation requires reduction of this annual average benzene content in gasoline to no greater than 0.62 volume %.

One known route for reducing the benzene content of gasoline is to selectively alkylate the benzene using a lower olefin. For example, Holtermann et al U.S. Pat. No. 5,149,894 describes a process for converting benzene to alkylated benzenes in a gasoline blend stock. The process involves contacting a benzene-containing gasoline blend stock with a C2 to C4 olefin stream in the presence of a catalyst containing the zeolite, SSZ-25, to produce an alkylated light hydrocarbon stream with reduced benzene content.

Cheng et al. U.S. Pat. No. 5,545,788 describes a process for the production of a more environmentally suitable gasoline by removing a substantial portion of benzene in gasoline by alkylation of reformate. The process involves alkylation using a light olefin feed at low temperature over the zeolite catalyst, MCM-49.

Umansky el al. U.S. Pat. No. 7,476,774 describes a process where light olefins including ethylene and propylene are extracted from refinery off-gases, such as from a catalytic cracking unit, into a light aromatic stream, such as a reformate containing benzene and other single ring aromatic compounds, which is then reacted with the light olefins to form a gasoline boiling range product containing alkylaromatics. The alkylation reaction is carried out in the liquid phase with a catalyst which preferably comprises a member of the MWW family of zeolites, such as MCM-22, using a fixed catalyst bed.

However, in addition to limiting the benzene level in gasoline, current and ongoing regulations restrict the content of residue, which consists of heavy hydrocarbon components with boiling points outside the gasoline boiling range. The US standard specification for automotive spark-ignition engine fuel (ASTM D4814) requires that the residue (heavies) in the gasoline product is no more than 2 volume %. As benzene regulations become more stringent, meeting the heavies level becomes an increasing problem because the light olefins used to alkylate the benzene in the gasoline can undergo undesirable competing reactions, such as olefin oligomerization to produce, for example, C6 to C8 olefins. Subsequent aromatic alkylation reactions result in the formation of heavy components, with boiling points outside of the typical gasoline boiling range.

According to the present invention, it has now been found that the undesirable formation of heavy components in the alkylation of a benzene-containing gasoline stream, such as a reformate or light naphtha, with an olefin alkylating agent can be reduced by recycling an aliquot of the effluent from the alkylation reaction, which effluent is essentially free of alkylating agent, so as to ensure that the molar ratio of alkylatable aromatic compounds to alkylating agent in the combined refinery gasoline and recycle streams to the alkylation reaction is at least 1.0:1.

SUMMARY

In one aspect, the invention resides in an process for alkylating benzene contained in a benzene-containing refinery gasoline stream, such as a reformate or a light naphtha, said process comprising contacting said benzene-containing refinery gasoline stream with an alkylating agent selected from one or more C2 to C5 olefins in at least one alkylation reaction zone under alkylation conditions to produce an alkylated effluent which has reduced benzene content as compared with said refinery gasoline stream and is essentially free of said alkylating agent, wherein an aliquot of the alkylated effluent is recycled to said one at least one alkylation reaction zone such that the molar ratio of alkylatable aromatic compounds to said alkylating agent in the combined refinery gasoline and recycle streams introduced into said at least one alkylation reaction zone is at least 1.0:1, for example, from about 4.0:1 to about 8.0:1.

Conveniently, the molar ratio of alkylatable aromatic compounds in said benzene-containing refinery gasoline stream to said alkylating agent introduced into said at least one alkylation reaction zone is about 0.1:1 to about 1.0:1.

Conveniently, the weight ratio of recycle to fresh refinery gasoline stream supplied to said at least one alkylation reaction zone is about 6.0:1 to about 10.0:1.

In one embodiment, the at least one alkylation reaction zone is in a single stage, fixed bed reactor, and all of said alkylating agent, all of said refinery gasoline stream and all of the recycled effluent are introduced into the inlet of the reactor.

Typically, the refinery gasoline stream comprises at least 4 volume % benzene and the alkylated effluent comprises less than 2 volume %, such as less than 0.62 volume %, benzene. Generally, the alkylated effluent comprises no more than 2 volume % of compounds having a boiling point greater than 236° C. at atmospheric pressure.

In one embodiment, the contacting in the at least one alkylation reaction zone takes place in the presence of a catalyst comprising an MWW zeolite and the alkylating agent is propylene.

The refinery gasoline stream may be substantially in the liquid phase during said contact of the refinery gasoline stream with the alkylating agent in the alkylation reaction zone.

DETAILED DESCRIPTION

Refinery streams which may be alkylated by the present process to decrease their benzene content include streams comprising benzene and alkylbenzenes. Examples of such streams include reformates and naphtha streams, especially light naphtha streams (typically boiling in the range from about 40° C. to about 150° C.). Blends of refinery streams may also be alkylated. The refinery streams employed in the present process typically comprise at least 4 volume % benzene, such as from 4 volume % to 40 volume % benzene.

Reformates have high octane number attributable to their high aromatics content. However, high concentrations of benzene in reformate, e.g., in excess of 4 volume %, can limit reformate utility as a gasoline blending component where environmental considerations require low benzene levels in gasoline products. Various efforts to reduce benzene content in reformate, e.g., selective hydrogenation, high temperature fluid-bed MBR, and reformate alkylation with methanol all suffer from octane losses or total liquid product losses associated with undesired cracking of C5+ non-aromatics.

The present invention relates to a process whereby benzene-containing reformates and other refinery streams are treated to reduce their benzene content by alkylation. Undesirable alkylation of higher boiling aromatics, such as xylenes, may be minimized.

Examples of suitable alkylating agents for use in the present process are olefins having 2 to 5 carbon atoms, such as ethylene, propylene, butenes, and pentenes. Mixtures of light olefins are especially useful as alkylating agents in the alkylation process of this invention. Accordingly, mixtures of ethylene, propylene, butenes, and/or pentenes which are major constituents of a variety of refinery streams, e.g., fuel gas, gas plant off-gas containing ethylene, propylene, etc., naphtha cracker off-gas containing light olefins, refinery FCC propane/propylene streams, and FCC off-gas, etc., are useful alkylating agents herein. Compositions of examples of olefin containing streams suitable for use as alkylating agents are described, for example, in U.S. Pat. No. 7,476,774.

The alkylation process may be conducted such that the organic reactants, i.e., the alkylatable aromatic compound and the alkylating agent, are brought into contact with a zeolite catalyst composition in a suitable alkylation reaction zone, such as, for example, in a flow reactor containing a fixed bed of the catalyst composition, under alkylation conditions effective to produce an alkylated effluent which has reduced benzene content as compared with said refinery gasoline stream and is essentially free (that is contains less than 0.1 wt %) of the alkylating agent. Generally, the alkylated effluent contains at least 50% less, such as at least 75% less, benzene as compared with said refinery gasoline stream.

Suitable alkylation conditions may include a temperature of from about 0° C. to about 500° C., for example, between about 50° C. and about 300° C., and a pressure of from about 0.2 to about 250 atmospheres, for example, from about 1 to about 50 atmospheres. The feed weight hourly space velocity (WHSV) will generally be between 0.1 $hr^{-1}$ and 500 $hr^{-1}$, for example, from 0.5 $hr^{-1}$ to 100 $hr^{-1}$. The latter WHSV is based upon the total weight of active catalyst (and binder if present). Generally, the molar ratio of alkylatable aromatic compounds in the refinery gasoline stream to the alkylating agent fed to the alkylation reaction zone is about 0.1:1 to about 1.0:1.

An aliquot of the alkylated effluent is recycled to the alkylation reaction zone such that the molar ratio of alkylatable aromatic compounds (including both the gasoline feed stream and the recycled aliquot of the alkylated effluent) to alkylating agent at the inlet of the alkylation reaction zone is at least 1.0:1, for example, from about 4.0:1 to about 8.0:1. The weight ratio of recycled to fresh refinery gasoline feed at the inlet of the alkylation zone may be, for example, from about 6.0:1 to about 10.0:1.

As used herein, the term "aliquot" is used in its commonly accepted sense to mean a portion of the alkylated effluent, which has not been subjected to fractionation or other operations to alter its composition and so has the same composition as the total effluent.

The reactants may be in the vapor phase or the liquid phase or in a mixture of liquid and vapor phases. The reactants may be neat, i.e., free from intentional admixture or dilution with other material, or they can be brought into contact with the zeolite catalyst composition with the aid of carrier gases or diluents such as, for example, hydrogen or nitrogen.

The alkylation reaction may be conducted in one or more than one alkylation reaction zones. When more than one alkylation zone is used, fresh refinery gasoline feed or fresh alkylating agent feed may, optionally, be introduced between one or more zones. In one embodiment, the reaction zone is in a single stage, fixed bed reactor, and all of the alkylating agent, all of the fresh refinery gasoline stream and all of the recycled effluent are introduced into the inlet of the reactor.

Catalyst System

The catalyst system used in the alkylation of the present process is preferably one based on a zeolite of the MWW family because these catalysts exhibit excellent activity for the desired aromatic alkylation reaction using light olefins, especially propylene. It is, however, possible to use other molecular sieve catalysts for this alkylation, including catalysts based on ZSM-12 as described in U.S. Pat. Nos. 3,755,483 and 4,393,262 for the manufacture of petrochemical cumene from refinery benzene and propylene or catalysts based on zeolite beta as described in U.S. Pat. No. 4,891,458, all of which are reported to have activity for the alkylation of light aromatics by propylene.

MWW Zeolite

The MWW family of zeolite materials has achieved recognition as having a characteristic framework structure which presents unique and interesting catalytic properties. The MWW topology consists of two independent pore systems: a sinusoidal ten-member ring [10 MR] two dimensional channel separated from each other by a second, two dimensional pore system comprised of 12 MR super cages connected to each other through 10 MR windows. The crystal system of the MWW framework is hexagonal and the molecules diffuse along the [100] directions in the zeolite, i.e., there is no communication along the c direction between the pores. In the hexagonal plate-like crystals of the MWW type zeolites, the crystals are formed of relatively small number of units along the c direction as a result of which, much of the catalytic activity is due to active sites located on the external surface of the crystals in the form of the cup-shaped cavities. In the interior structure of certain members of the family such as MCM-22, the cup-shaped cavities combine together to form a supercage. The MCM-22 family of zeolites has attracted significant scientific attention since its initial announcement by Leonovicz et al. in Science 264, 1910-1913 [1994] and the later recognition that the family includes a number of zeolitic materials such as PSH 3, MCM-22, MCM-49, MCM-56, SSZ-25, ERB-1, ITQ-1, and others. Lobo et al. A1ChE Annual Meeting 1999, Paper 292J.

The relationship between the various members of the MCM-22 family have been described in a number of publications. Significant members of the family are MCM-22, MCM-36, MCM-49, and MCM-56. When initially synthesized from a mixture including sources of silica, alumina, sodium, and hexamethylene imine as an organic template, the initial product will be MCM-22 precursor or MCM-56, depending upon the silica: alumina ratio of the initial synthesis mixture. At silica:alumina ratios greater than 20, MCM-22 precursor comprising H-bonded vertically aligned layers is produced whereas randomly oriented, non-bonded layers of MCM-56 are produced at lower silica:alumina ratios. Both these materials may be converted to a swollen material by the use of a pillaring agent and on calcination, this leads to the laminar, pillared structure of MCM-36. The as-synthesized MCM-22 precursor can be converted directly by calcination to MCM-22 which is identical to calcined MCM-49, an intermediate product obtained by the crystallization of the randomly oriented, as-synthesized MCM-56. In MCM-49, the layers are covalently bonded with an interlaminar spacing slightly greater than that found in the calcined MCM-22/MCM-49 materials. The as-synthesized MCM-56 may be calcined itself to form calcined MCM-56 which is distinct from calcined MCM-22/MCM-49 in having a randomly oriented rather than a laminar structure. In the patent literature MCM-22 is described in U.S. Pat. No. 4,954,325 as well as in U.S. Pat. Nos. 5,250,777; 5,284,643 and 5,382,742. MCM-49 is described in U.S. Pat. No. 5,236,575; MCM-36 in U.S. Pat. No. 5,229,341 and MCM-56 in U.S. Pat. No. 5,362,697.

A preferred zeolitic material for use as the MWW component of the catalyst system is MCM-22.

Catalyst Matrix

In addition to the zeolitic component, the catalyst will usually contain a matrix material or binder in order to give adequate strength to the catalyst as well as to provide the desired porosity characteristics in the catalyst. High activity catalysts may, however, be formulated in the binder-free form by the use of suitable extrusion techniques, for example, as described in U.S. Pat. No. 4,908,120. When used, matrix materials suitably include alumina, silica, silica alumina, titania, zirconia, and other inorganic oxide materials commonly used in the formulation of molecular sieve catalysts. For use in the present process, the level of zeolite, such as MCM-22 or ZSM-5 type (intermediate pore size) zeolite, in the finished matrixed catalyst will be typically from 20 to 70% by weight, and in most cases from 25 to 65% by weight. In manufacture of a matrixed catalyst, the active ingredient will typically be mulled with the matrix material using an aqueous suspension of the catalyst and matrix, after which the active component and the matrix are extruded into the desired shape, for example, cylinders, hollow cylinders, trilobe, quadlobe, etc. A binder material such as clay may be added during the mulling in order to facilitate extrusion, increase the strength of the final catalytic material and to confer other desirable solid state properties. The amount of clay will not normally exceed 10% by weight of the total finished catalyst. Unbound (or, alternatively, self-bound) catalysts are suitably produced by the extrusion method described in U.S. Pat. No. 4,582,815, to which reference is made for a description of the method and of the extruded products obtained by its use. The method described there enables extrudates having high constraining strength to be produced on conventional extrusion equipment and accordingly, the method is suitable for producing the catalysts which are silica-rich. The catalysts are produced by mulling the zeolite with water to a solids level of 25 to 75 wt % in the presence of 0.25 to 10 wt % of basic material such as sodium hydroxide. Further details are to be found in U.S. Pat. No. 4,582,815.

Gasoline Product

Even with a refinery gasoline feed comprising at least 4 volume % benzene, the present process allows the production of a gasoline product which contains less than 2 volume %, typically less than 0.62 volume %, benzene and generally no more than 2 volume % of compounds having a boiling point greater than 236° C. at atmospheric pressure. In addition, it is to be appreciated that, unlike conventional processes for alkylating aromatics with C2 to C5 olefins, the entire alkylated product of the present process is intended for use as a gasoline blending component, without fractionation to separate the product into monoalkylated species, polyalkylated species and unreacted aromatic feed.

The invention will now be more particularly described with reference to the following non-limiting Examples.

COMPARATIVE EXAMPLE 1

Alkylation of a synthetic benzene containing reformate stream with propylene was carried out in a fixed bed once-through reactor. The reactor was loaded with a fixed bed alkylation catalyst. The synthetic reformate feed comprised 15% benzene, 4% toluene and 81% n-heptane and was introduced into the reactor at a flow rate of 100 grams per hour, with the reactor being heated to the reaction temperature of 200° C. before propylene charge was introduced. The reactor pressure was kept above the vapor pressure of the reaction mixture to ensure liquid phase operation. The reactor performance was evaluated at three different propylene charge rates. The results are listed in Table 1, wherein the three charge rates are designated as 1A, 1B and 1C.

TABLE 1

| Charge Rate | 1A | 1B | 1C |
|---|---|---|---|
| Feed Aromatic to Propylene Ratio (molar) | 0.92 | 0.80 | 0.65 |
| Total Aromatic to Propylene Ratio at Reactor Inlet (molar) | 0.92 | 0.80 | 0.65 |
| Effluent Benzene (volume %) | 2.3 | 1.6 | 0.70 |
| Effluent Heavies (volume %) | 0.8 | 1.3 | 2.9 |
| Benzene Conversion (%) | 82 | 87 | 94 |

As shown in Table 1, the benzene content in the reactor effluent decreased as propylene charge was increased. However, the effluent heavies content also increased with increasing propylene charge and went above 2 volume % before the target 0.62 volume % benzene content was reached. The heavies content includes all the compounds that have a higher boiling point than 236° C. at atmospheric pressure. This reactor system was therefore not capable of achieving both high benzene conversion and low heavies make simultaneously and was unable to produce a gasoline product that met both the <0.62 volume % benzene content and the <2 volume % distillation residue specifications without fractionation of the reactor effluent to remove excess benzene and/or heavies.

EXAMPLE 2

In addition to the reactor setup and catalyst described in Comparative Example 1, a reactor effluent pump was installed downstream of the reactor. The reactor effluent pump recycled an aliquot of the reactor effluent to the reactor inlet in order to control the reactor inlet aromatic to propylene ratio. As the propylene at the reactor inlet is essentially completely consumed in the reactor, the reactor effluent contains essentially no propylene. The number of moles of aromatic in the reactor effluent, however, is essentially the same as that in the reactor inlet, as the aromatics compounds are not destroyed but only alkylated to higher molecular weight aromatic compounds. The reactor effluent, therefore, has an aromatic to propylene ratio of essentially infinity. Recycling an aliquot of the reactor effluent back to the reactor inlet, therefore, increases the reactor inlet aromatic to propylene ratio.

The same synthetic reformate feed described in Comparative Example 1 was introduced into the reactor at a flow rate of about 144 grams per hour, and a reactor effluent recycle of about 1,150 grams per hour was established with the reactor effluent pump. The reactor was heated up to the reaction temperature of 200° C. before propylene charge was introduced and the reactor pressure was kept above the vapor pressure of the reaction mixture to ensure liquid phase operation. The reactor performance was evaluated at three different propylene charge rates. The results are listed in Table 2, wherein the three charge rates are designated as 2A, 2B and 3C.

TABLE 2

| Charge Rate | 2A | 2B | 2C |
|---|---|---|---|
| Recycle/Feed Ratio (w/w) | 8 | 8 | 8 |
| Feed Aromatic to Propylene Ratio (molar) | 0.91 | 0.77 | 0.60 |
| Total Aromatic to Propylene Ratio at Reactor Inlet (molar) | 8.2 | 7.0 | 5.4 |
| Effluent Benzene (volume %) | 2.2 | 1.3 | 0.48 |
| Effluent Heavies (volume %) | 0.34 | 0.7 | 1.8 |
| Benzene Conversion (%) | 82 | 90 | 96 |

As shown in Table 2, the reactor effluent benzene content decreased and the heavies content increased with increasing propylene charge, as expected. Further, the reactor effluent increased the aromatic to propylene ratio at the reactor inlet and reduced the propylene oligomerization and heavies make. The run designated as 2C in Table 2 demonstrated that the reactor scheme employed in this Example reached the desired benzene content of <0.62 volume % before the heavies content exceeded the 2 volume % limit. The recycle reactor system employed in this Example was therefore demonstrated capable of achieving both high benzene conversion and low heavies make simultaneously and produced a gasoline product that met both the <0.62 volume % benzene content and <2 volume % distillation residue specifications without fractionation of the reactor effluent to remove excess benzene and/or heavies.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for reducing the benzene content of gasoline by alkylating benzene contained in a benzene-containing refinery gasoline stream, said process comprising contacting said benzene-containing refinery gasoline stream with an alkylating agent selected from one or more C2 to C5 olefins in at least one alkylation reaction zone under alkylation conditions to produce an alkylated effluent which has reduced benzene content as compared with said refinery gasoline stream and is essentially free of said alkylating agent, wherein an aliquot of the alkylated effluent is recycled to said one at least one alkylation reaction zone such that the molar ratio of alkylatable aromatic compounds to said alkylating agent in the combined refinery gasoline and recycle streams introduced into said at least one alkylation reaction zone is at least 1.0:1, and wherein the molar ratio of alkylatable aromatic compounds in said benzene-containing refinery gasoline stream to said alkylating agent introduced into said at least one alkylation reaction zone is about 0.1:1 to about 1.0:1.

2. A process according to claim 1, wherein the molar ratio of alkylatable aromatic compounds to said alkylating agent in the combined refinery gasoline and recycle streams introduced into said at least one alkylation reaction zone is 4.0:1 to 8.0:1.

3. A process according to claim 1, wherein the weight ratio of recycle to fresh refinery gasoline stream supplied to said at least one alkylation reaction zone is 6.0:1 to 10.0:1.

4. A process according to claim 1, wherein said reaction zone is in a single stage, fixed bed reactor, and wherein all of said alkylating agent, all of said refinery gasoline stream and all of the recycled effluent are introduced into the inlet of the reactor.

5. A process according to claim 1, wherein said refinery gasoline stream is a reformate or a light naphtha.

6. A process according to claim 1, wherein said alkylating agent is propylene.

7. A process according to claim 1, wherein said refinery gasoline stream comprises at least 4 volume % benzene.

8. A process according to claim 1, wherein said effluent comprises less than 2 volume % benzene.

9. A process according to claim 1, wherein said effluent comprises less than 0.62 volume % benzene.

10. A process according to claim 1, wherein said effluent comprises no more than 2 volume % of compounds having a boiling point greater than 236° C. at atmospheric pressure.

11. A process according to claim 1, wherein said contacting in the at least one alkylation reaction zone takes place in the presence of a catalyst comprising an MWW zeolite.

12. A process according to claim 1, wherein said refinery gasoline stream is substantially in the liquid phase during said contacting.

* * * * *